US007826774B2

(12) United States Patent
Cook et al.

(10) Patent No.: US 7,826,774 B2
(45) Date of Patent: Nov. 2, 2010

(54) METHODS TO CONTROL TRANSITIONS BETWEEN COLOR PRINTING AND BLACK-ONLY PRINTING IN AN IMAGE FORMING DEVICE

(75) Inventors: William Paul Cook, Lexington, KY (US); Ryan David Brockman, Lexington, KY (US); Larry Steven Foster, Lexington, KY (US); Kermit Arnold Meece, Lexington, KY (US); Travis Alan Riggs, Shelbyville, KY (US); Jeffrey Lawrence Tonges, Versailles, KY (US); Michael Hayes Wilson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 404 days.

(21) Appl. No.: 12/049,432

(22) Filed: Mar. 17, 2008

(65) Prior Publication Data

US 2009/0232554 A1 Sep. 17, 2009

(51) Int. Cl.
*G03G 15/01* (2006.01)
*G03G 15/06* (2006.01)

(52) U.S. Cl. ..... 399/228; 399/55

(58) Field of Classification Search ..... 399/285, 399/270, 223, 228, 55
See application file for complete search history.

(56) References Cited

U.S. PATENT DOCUMENTS 5,600,430 A * 2/1997 Folkins et al. ..... 399/223

FOREIGN PATENT DOCUMENTS

JP 2002268322 A * 9/2002

* cited by examiner

*Primary Examiner*—Susan S Lee

(57) ABSTRACT

The present application is directed to methods for transitioning between color printing and black-only printing in an image forming device. A cartridge is moved between a first position in which color printing may occur and a second position in which black-only printing may occur. In the first position, a color developer unit may be in contact with a color photoconductor unit. The color developer unit may be spaced from the color photoconductor unit in the second position. During the transition, a voltage supplied to the cartridge and a speed of a drive motor driving the cartridge may be adjusted.

20 Claims, 13 Drawing Sheets

METHODS TO CONTROL TRANSITIONS BETWEEN COLOR PRINTING AND BLACK-ONLY PRINTING IN AN IMAGE FORMING DEVICE

BACKGROUND

The present application is directed to methods for forming a toner image within an image forming device and, more particularly, to methods for controlling transitions between color printing and black-only printing.

Color image forming devices contain two or more cartridges, each of which transfers a different color of toner to a media sheet as required to produce a full color copy of a toner image. One common image forming device includes four separate cartridges for each of yellow, magenta, cyan, and black colors. Image formation for each cartridge includes moving the toner from a reservoir to a developer member, from the developer member to a photoconductive member, and from the photoconductive member to either a media sheet or an intermediate member. The toner images from each cartridge are formed on the media sheet in an overlapping arrangement that ultimately forms the final composite toner image.

In many devices, each cartridge is driven during image formation, even when one or more colors are not being used for the specific print job. When the cartridge is driven, the developer member forces toner through multiple compressive nips, even when the developer member is not actually transferring toner. Repeatedly passing toner through the compressive nips inflicts some level of damage to the toner. Worn or damaged toner particles may result in poor transfer to the photoconductive member, then poor transfer to the media sheet or intermediate member. Thus, each time a given particle of toner passes through a nip, the likelihood of that particle responding to the image formation process decreases.

Methods to reduce or eliminate undue wear on the toner would result in better overall efficiency of the image forming device. This in turn would increase the amount of toner available for transfer to the media sheets, and would decrease the amount of wasted toner.

SUMMARY

The present application is directed to methods for transitioning between color printing and black-only printing in an image forming device. A cartridge is moved between a first position in which color printing may occur and a second position in which black-only printing may occur. In the first position, a color developer unit may be in contact with a color photoconductor unit. The color developer unit may be spaced from the color photoconductor unit in the second position. During the transition, a voltage supplied to the cartridge and a speed of a drive motor driving the cartridge may be adjusted.

DETAILED DESCRIPTION

Figure 1:
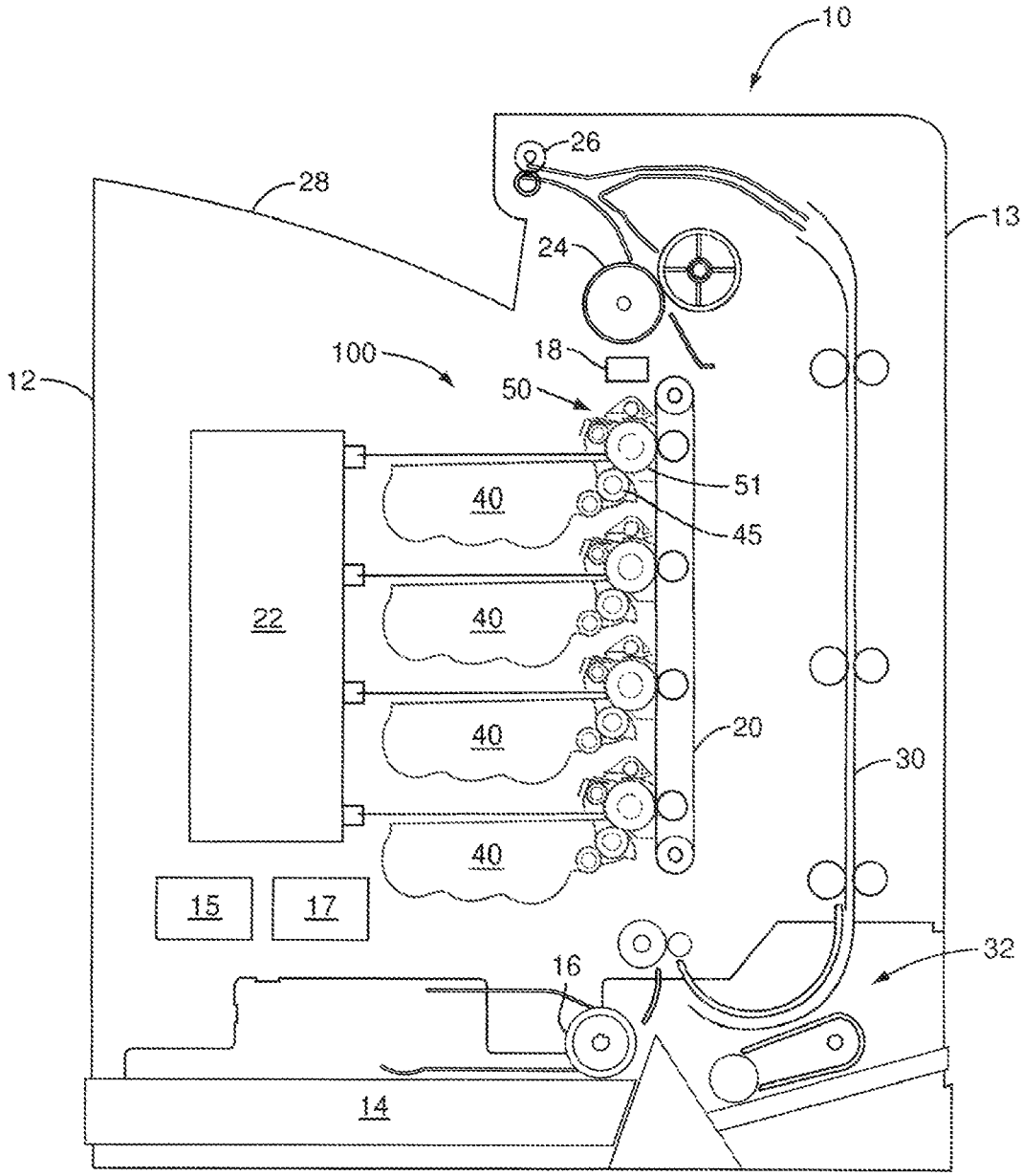
FIG. 1 is a schematic view of an image forming device according to one embodiment.

FIG. 1 illustrates a representative image forming device, such as a printer, indicated generally by the numeral 10. The image forming device 10 comprises a main body 12 and a subunit 13. A media tray 14 with a pick mechanism 16 or a manual input 32 are conduits for introducing media sheets in the device 10. The media tray 14 is preferably removable for refilling, and located on a lower section of the device 10.

Media sheets are moved from the input and fed into a primary media path. One or more registration rollers disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms an electrical charge on a photoconductive member 51 within the image forming units 100 as part of the image formation process. The media sheet with loose toner is then moved through a fuser 24 that adheres the toner to the media sheet. Exit rollers 26 rotate in a forward or a reverse direction to move the media sheet to an output tray 28 or a duplex path 30. The duplex path 30 directs the inverted media sheet back through the image formation process for forming an image on a second side of the media sheet.

A controller 15 is included within the image forming device 10 to control creation and timing of the toner images, and movement of the media sheets. The controller 15 may include a microprocessor with associated memory. In one embodiment, the controller 15 includes a microprocessor, random access memory, read only memory, and an input/output interface. The controller 15 receives print requests and forms a print queue of each of the pages in the requests. The queue may include the pages from a single print request, or may include pages from two or more different print requests. The controller 15 further includes a raster image processor that turns vector digital information received in the print requests into a high-resolution raster image. The controller 15 is then able to determine whether each of the pages requires a multi-color mode due to two or more colors of toner being necessary to form the image, or a mono-color mode when a single color (e.g., black) of toner is necessary to form the image.

The image forming units 100 are constructed of a cartridge 40 (in this embodiment, a developer unit) and a photoconductor unit 50. The cartridge 40, including a developer member 45, is positioned within the main body 12. The photoconductor unit 50, including the photoconductive member 51, is mounted to the subunit 13. In a closed orientation as illustrated in FIG. 1, the subunit 13 is positioned adjacent to the main body 12 with the photoconductive member 51 of the photoconductor unit 50 against the developer member 45 of the cartridge 40.

Figure 2:
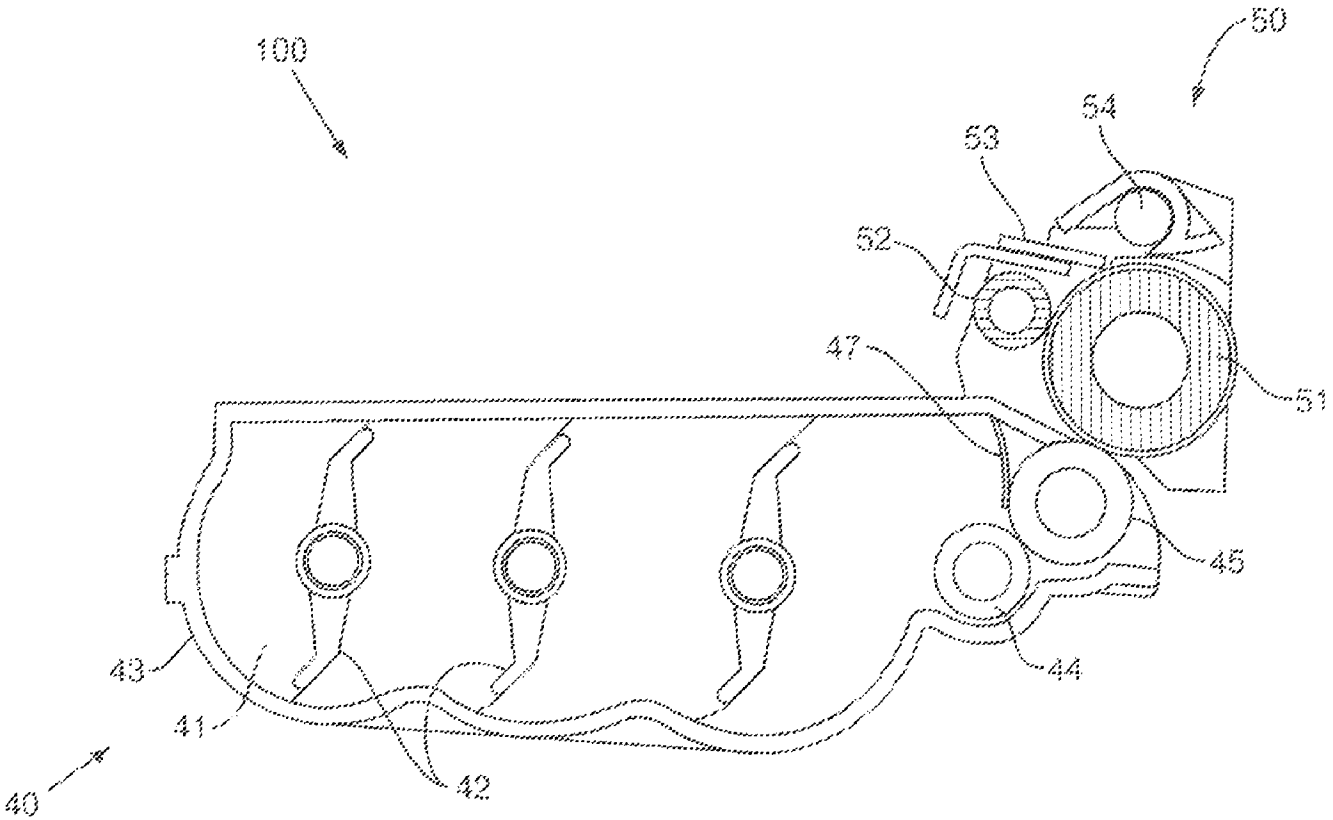
FIG. 2 is a cross-sectional view of an image forming unit according to one embodiment.
Figure 3:
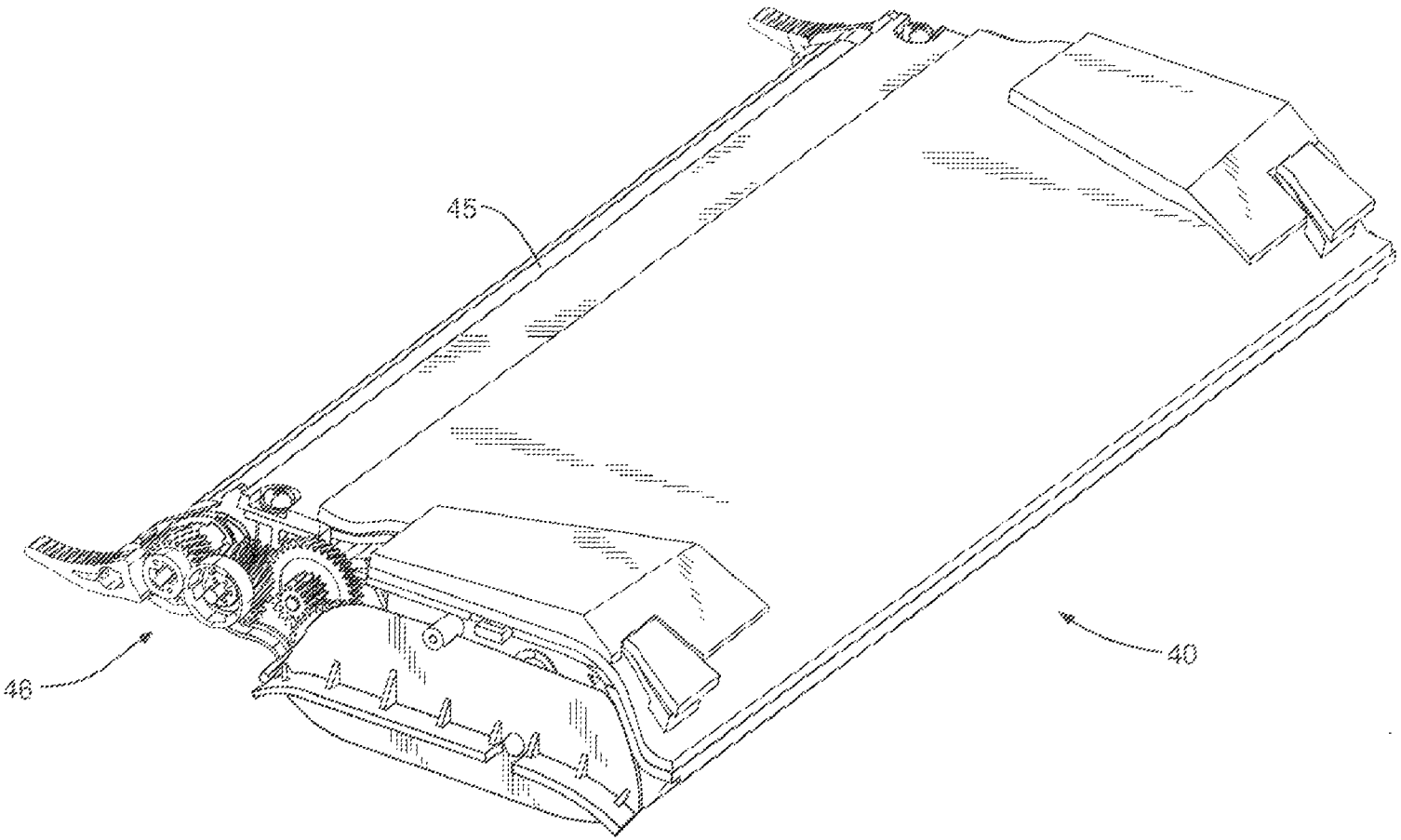
FIG. 3 is a perspective view of a developer unit according to one embodiment.

FIG. 2 illustrates a cross-sectional view of the image forming unit 100 in the closed orientation. The cartridge 40 comprises an exterior housing 43 that forms a reservoir 41 for holding a supply of toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The cartridge 40 is structured with the developer member 45 on an exterior section where it is accessible for being in contact with the photoconductive member 51 as illustrated in FIG. 3.

A drive motor 18 (see FIG. 1) may operatively connect to the gears 46 of the cartridge 40. In one embodiment, the drive motor 18 drives both the developer member 45 and the agitating members 42 by engaging one or more of the gears 46. The drive motor 18 may also drive more than one cartridge. In one embodiment, a single drive motor 18 drives the developer members 45 and agitating members 42 for the three color (magenta, cyan, and yellow) cartridges 40 in the image forming device 10. In this embodiment, the rotation of the developer members 45, as well as the agitating members 42, of all three color cartridges 40 may be stopped simultaneously by stopping the single drive motor 18. In another embodiment, each cartridge 40 has a dedicated drive motor 18.

Figure 4:
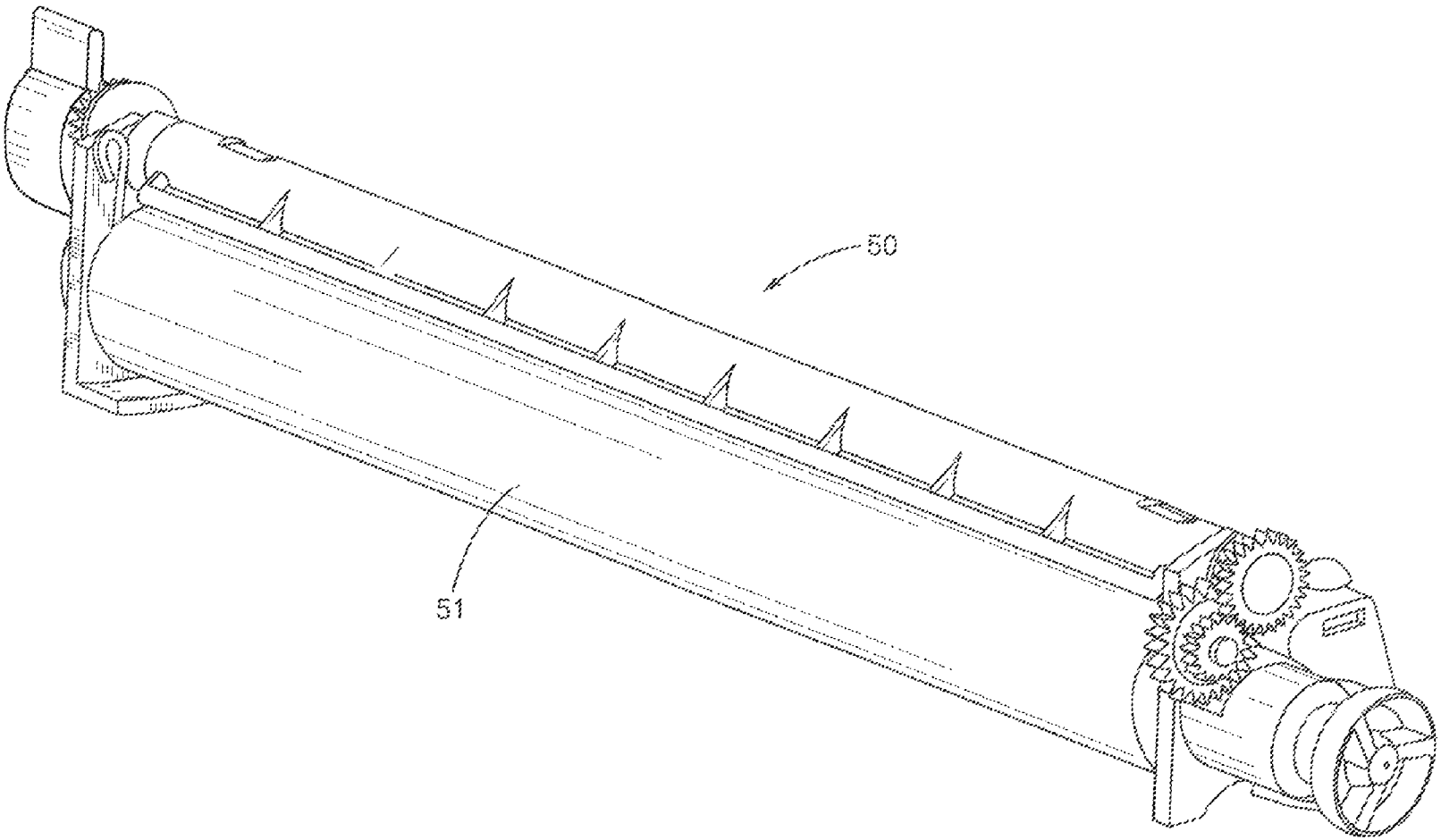
FIG. 4 is a perspective view of a photoconductor unit according to one embodiment.

The photoconductor unit 50 is illustrated in FIG. 2 and comprises the photoconductive member 51. The photoconductor unit 50 may also include a charger 52 that applies an electrical charge to the photoconductive member 51 to receive an electrostatic latent image from the imaging device 22. A cleaner blade 53 contacts the surface of the photoconductive member 51 to remove any toner that remains on the photoconductive member 51. The residual toner is moved to a waste toner auger 54 and moved out of the photoconductor unit 50. As illustrated in FIG. 4, the photoconductive member 51 is mounted on an exterior of the photoconductor unit 50 so it may be placed in contact with the developer member 45.

Figure 5:
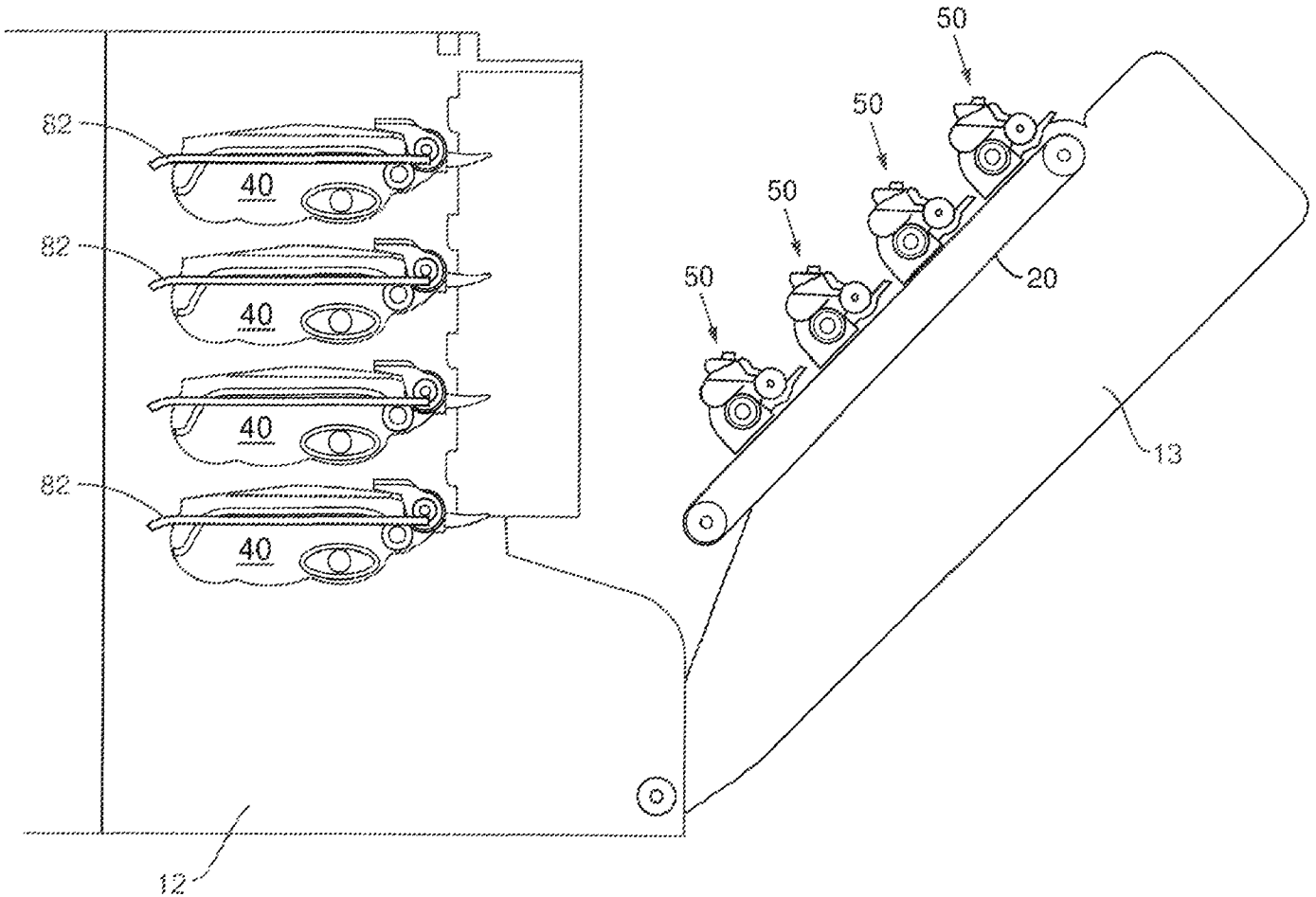
FIG. 5 is a cut-away side view of a subunit pivoted away from a main body of an image forming device according to one embodiment.

In an open orientation as illustrated in FIG. 5, the subunit 13 is moved away from the main body 12 separating the photoconductor unit 50 from the cartridge 40. This configuration provides direct and easy user access to the cartridge 40, photoconductor unit 50, and the media path. One embodiment of this two-piece cartridge design is described in U.S. Pat. No. 7,136,609 entitled "Movable Subunit and Two Piece Cartridge for Use in an Image Forming Device" issued on Nov. 14, 2006 and assigned to Lexmark International, Inc., the owner of the present application, and herein incorporated by reference in its entirety.

The image forming device 10 may include one or more power supplies, indicated generally by reference number 17 in FIG. 1. The power supply 17 may provide the voltage necessary to electrically bias the photoconductive member 51 and bias the developer member 45. In addition, the power supply 17 may provide power for a variety of motors and sensors located throughout the image forming device 10. The power supply 17 may, in some embodiments, be distributed to various locations within device 10, and may include suitable sections for AC and DC power, as is appropriate.

As illustrated in FIG. 5, the cartridge 40 includes guide rails 82 extending from two sides of the cartridge 40. The guide rails 82 are used for mounting the cartridge 40 in the main body 12 of the image forming device 10. The main body 12 includes a plurality of rollers 83 that extend outward and support the guide rails 82. In one embodiment, a non-gear side (FIG. 6) of the cartridge 40 is supported by two rollers 83, and a gear side (FIG. 7) is supported by one roller 83. When fully inserted, a back edge of the cartridge 40 contacts against one or more biasing members 85. The biasing members 85 may apply a force outward from the main body 12 (i.e., towards the right as illustrated in FIG. 5). One embodiment of the biasing members 85 is described in U.S. Pat. No. 7,082,275 entitled "Variable Force Biasing Mechanism and Electrical Connection" issued on Jul. 25, 2006 and assigned to Lexmark International, Inc., the owner of the present application, and herein incorporated by reference in its entirety. In one embodiment, the biasing members 85 provide an electrical contact between the main body 12 and the cartridge 40. Various embodiments may include biasing members 85 providing both electrical and mechanical contact, only electrical contact, or only mechanical contact.

Figure 6:
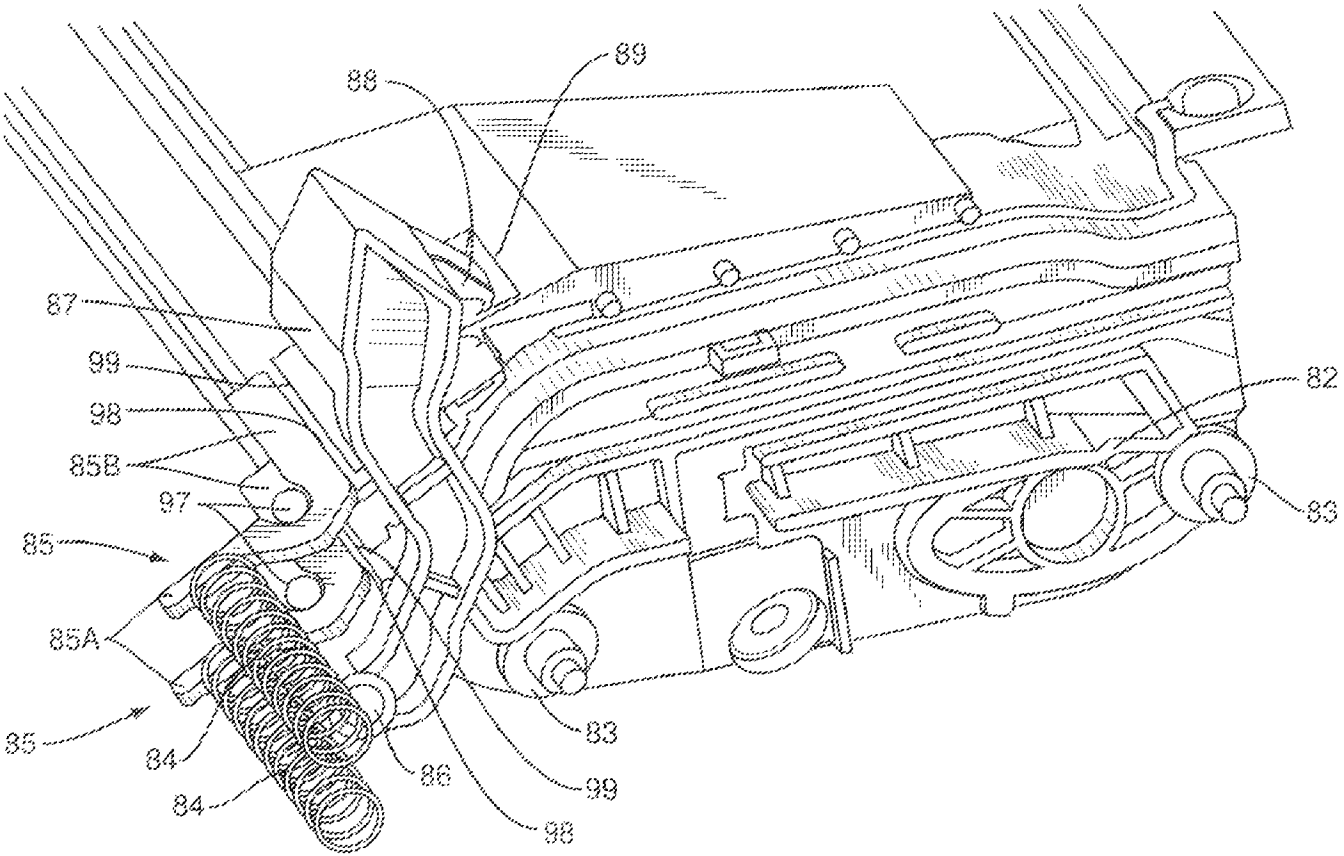
FIG. 6 is a partial perspective view of one side of a developer unit according to one embodiment.

FIG. 6 illustrates the cartridge 40 mounted in the main body 12 and in contact with the biasing members 85. The biasing member 85 may have a generally "L" shaped configuration, with a pivoting arm 85A pivotally disposed about a pivot member 97 and acted upon by a force generating member 84 (such as a spring). The pivot member 97 is rigidly affixed to the body 12 of the image forming device 10. As viewed in FIG. 6, the force generating member 84 causes the biasing member 85 to rotate in a clockwise direction. The biasing member 85 also includes a contacting arm 85B having a biasing edge 98. As the biasing member 85 rotates due to the action of the force generating member 84, the biasing edge 98 contacts the cartridge at contact surface 99.

When the subunit 13 is in the closed position, the photoconductive member 51 contacts the developer member 45 of the cartridge 40, thereby generating a nip force between the two members 45, 51. Because the guide rails 82 of the cartridge 40 are positioned on the rollers 83, the cartridge 40 may tend to roll away from the photoconductive member 51 due to the nip force. However, the biasing members 85 oppose movement of the cartridge 40 and maintain the nip force between the photoconductive member 51 and the developer roller 45.

Figure 7:
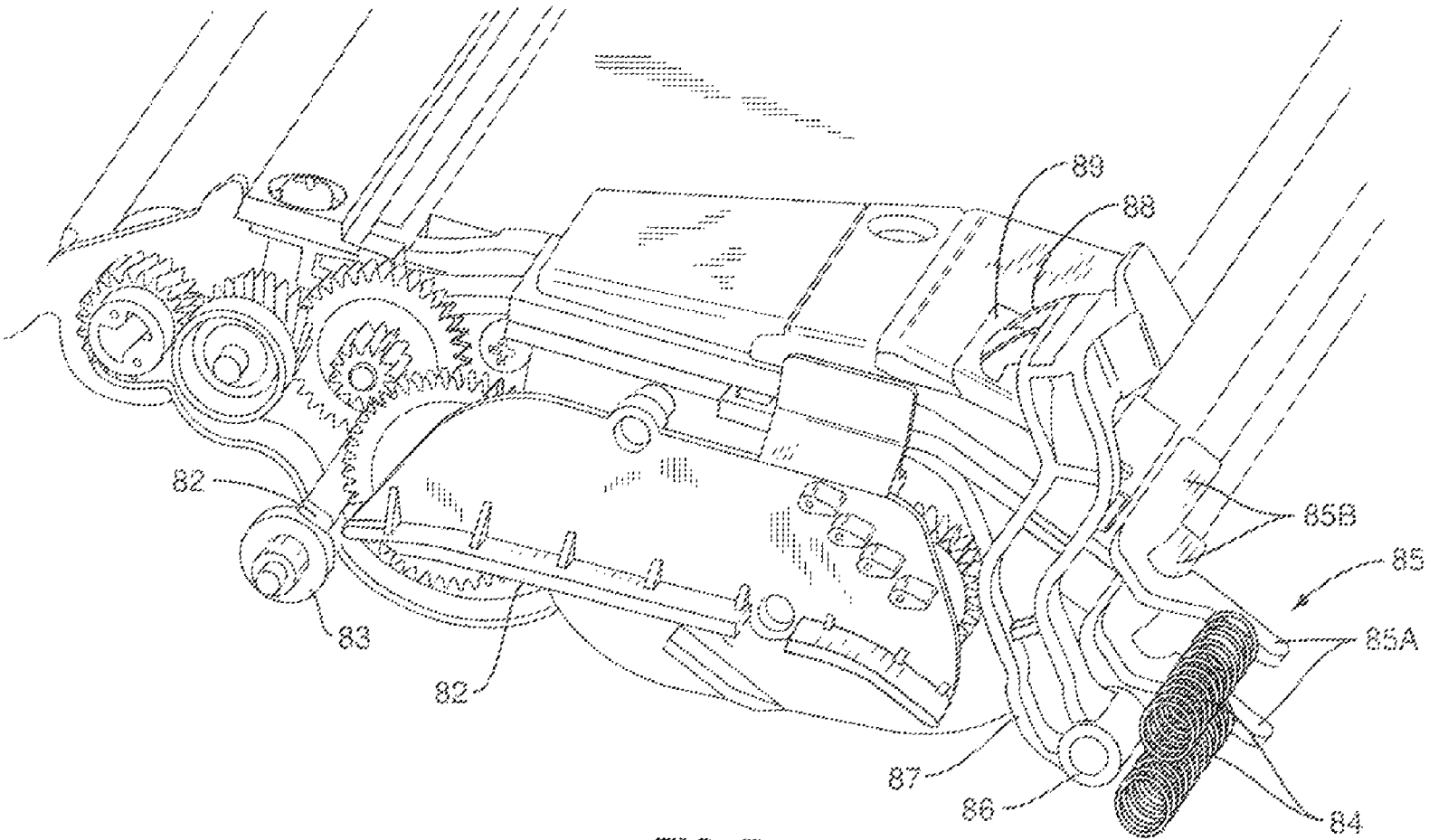
FIG. 7 is a partial perspective view of a second side of a developer unit according to one embodiment.

One or more electrical connectors 87 may also contact the cartridge 40. One embodiment includes two electrical connectors 87, one located in proximity to the non-gear side of the cartridge 40 as illustrated in FIG. 6, and the other located in proximity to the gear side of the cartridge 40 as illustrated in FIG. 7. One end of the electrical connector 87 is pivotably attached to the main body 12 at pivot 86. An end of the electrical connector 87 opposite from the pivot 86 includes a contactor 88 that engages the cartridge 40 at contact surface 89. A spring (not shown) may contact the electrical connector 87 and cause counter-clockwise rotation about the pivot 86 as viewed in FIG. 7 and urge the electrical connector 87 into contact with the cartridge 40. One embodiment of the electrical connector 87 is described in U.S. patent application Ser. No. 11/964,347 entitled "Electrical Connector for an Image Forming Device" filed on Dec. 26, 2007 and assigned to Lexmark International, Inc., the owner of the present application, and herein incorporated by reference in its entirety.

When the biasing members 85 and the electrical connectors 87 are in contact with the cartridge 40, the cartridge 40 is biased toward a printing (engaged) position in which the developer member 45 is in contact with the photoconductive member 51. As long as the cartridge 40 is in the printing position, the developer member 45 is rotated and the agitating members 42 churn the toner within the reservoir 41 through connection of at least one gear on the cartridge 40 with the drive motor 18. These actions occur regardless of whether the toner in the reservoir 41 will be used during image formation of the present toner image (for example, color toner may not be used when printing a black-only image). Thus, it would be advantageous to stop rotation of the developer member 45 and toner agitating members 42 when not required for the current image. This may prevent undesired consumption of color toner, as well as reduce the amount of toner churning. Before the developer member 45 and the agitating members 42 can be stopped, it may be advantageous to move the cartridge 40 away from the printing position to a retracted position such that the developer member 45 is spaced apart from (not in contact with) the photoconductive member 51.

Because the guide rails 82 of the cartridge 40 are supported by a plurality of rollers 83, the cartridge 40 may be free to slide along the rollers 83 in the absence of sufficient biasing force. Free movement of the cartridge 40 may be enhanced by sloping the guide rails 82 or the alignment of the rollers 83 such that gravitational forces cause the cartridge 40 to slide along the rollers 83 when the biasing forces are removed. Thus, by removing the biasing forces, the cartridge 40 may move to the retracted position, at which time the rotation of the developer member 45 and agitating members 42 may be stopped.

FIGS. 8A-D illustrate one embodiment of a bias control arm 91 operative to adjust the biasing force on one or more cartridges 40 within the main body 12. Bias control arm 91 comprises an elongated structure movable in the direction indicated by arrow A. The bias control arm 91 includes one or more positioning members 93 that translate the movement of the bias control arm 91 into movement of the cartridge 40 in the direction indicated by arrow B. The direction of arrow B is different than the direction of arrow A, and in one embodiment the directions are approximately perpendicular. One embodiment of the bias control arm 91 is described in U.S. patent application Ser. No. 12/049,422 entitled "Devices and Methods for Retracting a Cartridge in an Image Forming Device" filed on Mar. 17, 2008 and assigned to Lexmark International, Inc., the owner of the present application, and herein incorporated by reference in its entirety.

Figure 8A:
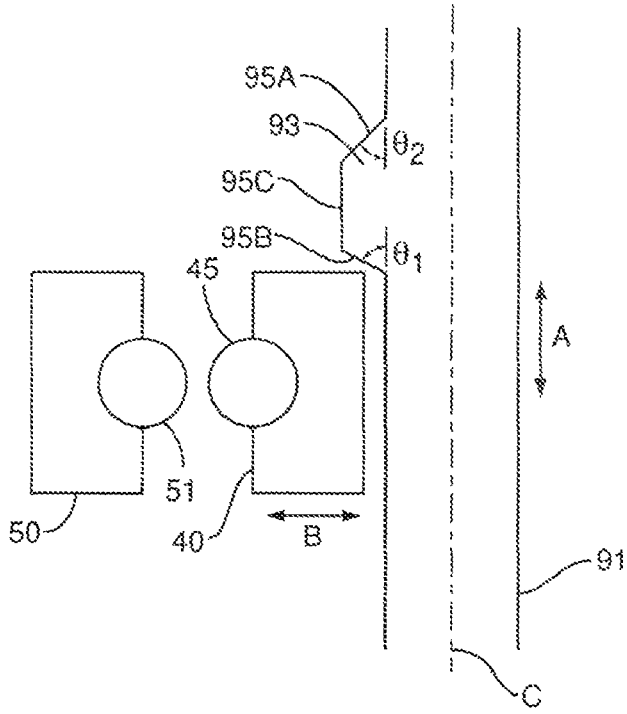
FIGS. 8A-8D are schematic views of a bias control arm contacting a cartridge according to one embodiment.

The translation of movement is affected by lower positioning surface 95B. As the bias control arm 91 moves downward as illustrated in FIG. 8A, the lower positioning surface 95B contacts the cartridge 40. The lower positioning surface 95B is oriented at an angle $\theta_1$ with respect to a centerline C of the bias control arm 91. As the bias control arm 91 continues to move downward, the angled lower positioning surface 95B exerts a biasing force on the cartridge 40 that pushes the cartridge 40 to the left as viewed in FIG. 8B until the developer member 45 contacts the photoconductive member 51. A maximum nip force between the developer member 45 and the photoconductive member 51 may be generated when a middle positioning surface 95C is in contact with the cartridge 40 as illustrated in FIG. 8C. In one embodiment, an amount of downward movement of the bias control arm 91 depends on a desired nip force.

Figure 8B:
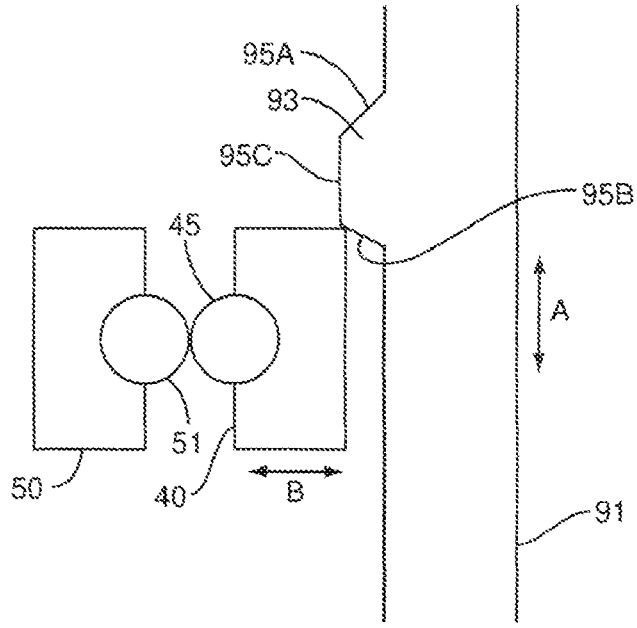
Figure 8C:
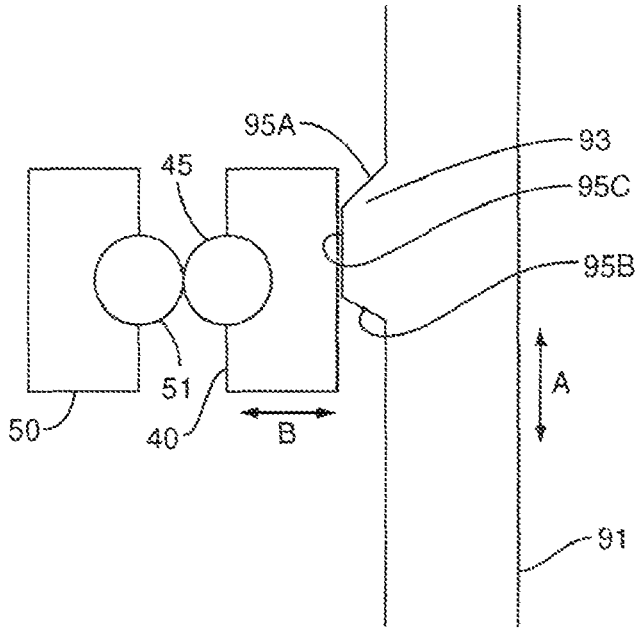
Figure 8D:
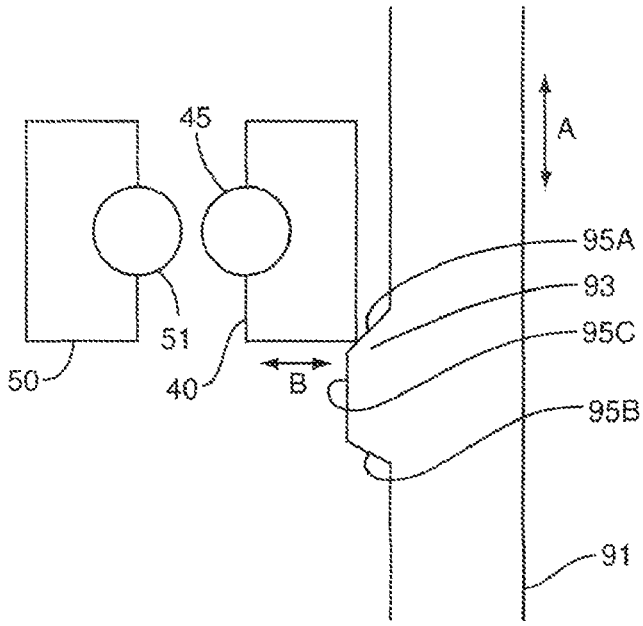

To lessen or remove the biasing force from the developer member 45, the bias control arm 91 may be moved upward to reverse the sequence illustrated in FIGS. 8A-C. Alternatively, the bias control arm 91 may be moved further downward until upper positioning surface 95A is in contact with the cartridge 40 as illustrated in FIG. 8D. The bias control arm 91 may be moved (upward or downward) until the biasing force is reduced to a level where the cartridge 40 moves away from the photoconductor unit 50, spacing the developer member 45 away from the photoconductive member 51. An angle $\theta_2$ at which the upper positioning surface 95A is oriented to the centerline C may be the same as or different than angle $\theta_1$.

Figure 9:
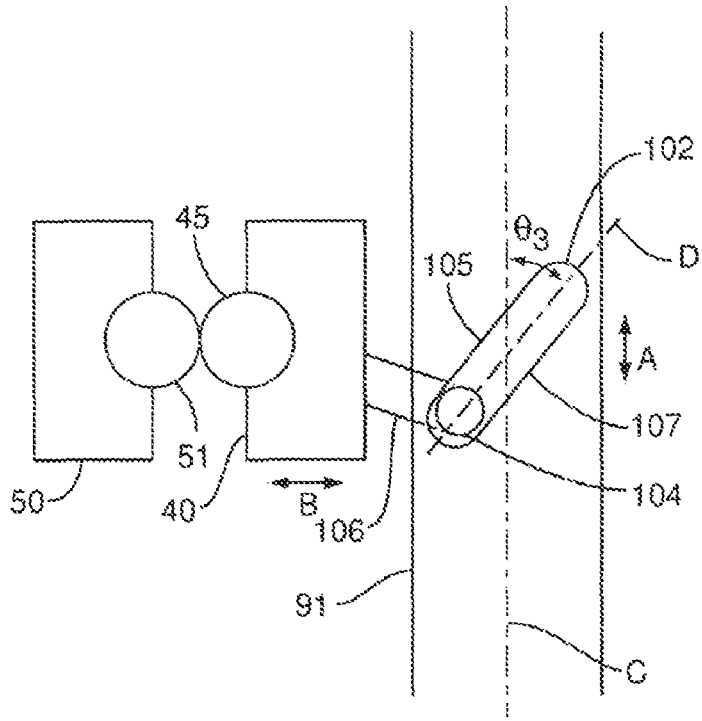
FIG. 9 is a schematic view of a bias control arm according to one embodiment.

In another embodiment as illustrated in FIG. 9, the angled positioning surfaces that cause the cartridge 40 to move in the direction of arrow A are located internally to the bias control arm 91 rather than on an outer surface as illustrated in FIGS. 8A-D. In this embodiment, one end of a connecting rod 106 is in contact with the cartridge 40, and another end is connected to a pin 104. The pin 104 is in communication with a slot 102 in the bias control arm 91. The slot 102 has a centerline D which is oriented at an angle $\theta_3$ to the centerline C of the bias control arm 91. Thus, as illustrated in FIG. 9, as the bias control arm 91 moves downward, the pin 104 is forced upward in the slot 102 by positioning surfaces 105, 107, and the cartridge 40 moves away from the photoconductor unit 50, and the developer member 45 is spaced apart from the photoconductive member 51. Conversely, as the bias control arm 91 moves upward, the pin 102 moves toward the lower end of the slot 102, and the developer member 45 is brought into contact with the photoconductive member 51. As the angle $\theta_3$ increases (that is, the centerline D becomes more horizontal as viewed in FIG. 9), a given amount of movement of the bias control arm 91 in the direction of arrow A results in less movement of the cartridge 40 in the direction of arrow B.

Figure 10:
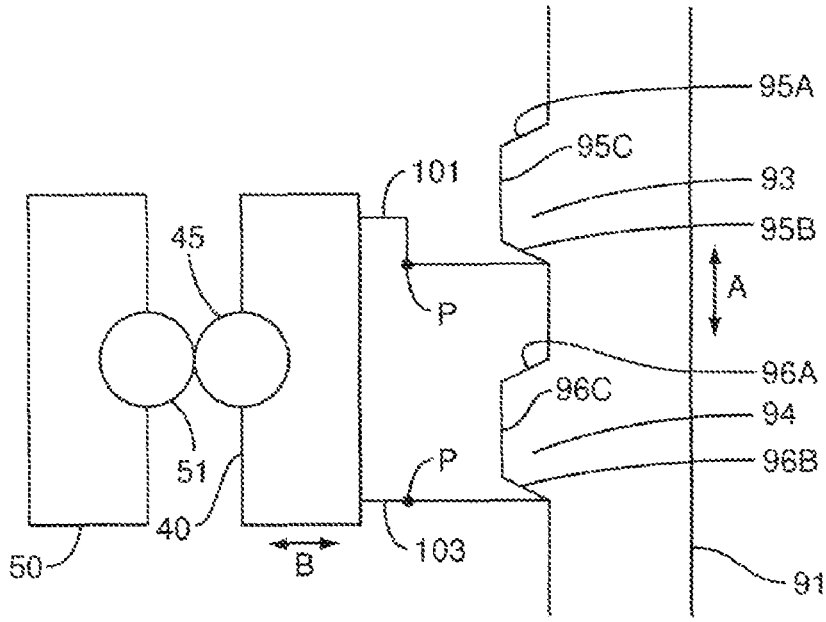
FIG. 10 is a schematic view of a bias control arm according to one embodiment.

While FIGS. 8A-D and 9 illustrate the bias control arm 91 directly providing the biasing force for the cartridge 40, in another embodiment one or more intermediate members may provide the biasing force, and the bias control arm 91 acts upon these intermediate members. FIG. 10 illustrates two members 101, 103 maintaining the cartridge 40 in a position such that the developer member 45 is in contact with the photoconductive member 51. While FIG. 10 illustrates both members 101, 103 present, other embodiments may include only one member 101, 103. Similar to the description above, as the bias control member moves downward as viewed in FIG. 10, lower positioning surfaces 95B, 96B of positioning members 93, 94 contact the members 101, 103. As the bias control arm 91 continues to move downward, the members 101, 103 pivot about pivot points P and at least partially retract from the cartridge 40. At some point, a force exerted by the members 101, 103 on the cartridge 40 decreases such that the cartridge 40 moves away from the photoconductor unit 50.

Figure 11:
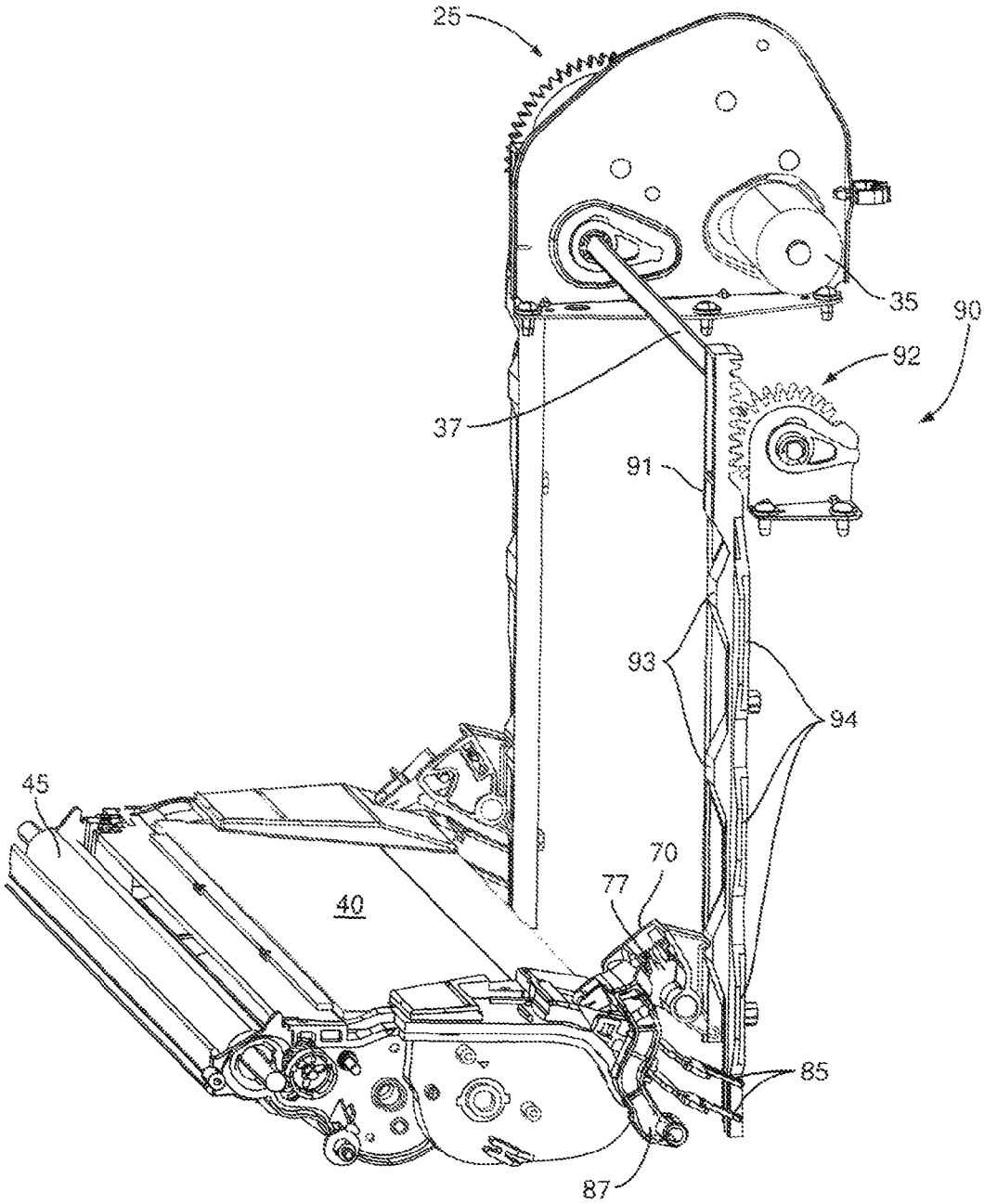
FIG. 11 is a perspective view of a cartridge and subassembly including a bias control arm according to one embodiment.

FIG. 11 illustrates one embodiment of a subassembly 90 operative to remove or lessen the biasing force on one or more cartridges 40 using the bias control arm 91 with two positioning surface 93, 94. In this embodiment, two biasing members 85 and one electrical connector 87 contact each end of the cartridge 40. The subassembly 90 retracts one or more of the biasing members 85 and electrical connectors 87 from contact with the cartridge 40. The subassembly 90 includes a motor 35 operatively connected through a gear train 25 to a bias the control arm 91. The bias control arm 91 is configured to selectively disengage one or more of the biasing members 85 and electrical connectors 87 from contact with the cartridge 40. As one or more of the biasing members 85 and electrical connectors 87 are disengaged, the biasing force exerted on the cartridge 40 is reduced until the cartridge 40 slides along the rollers 83 away from the printing position.

For purposes of clarity, only a single cartridge 40 is illustrated in FIG. 11, although typically four cartridges would be in place in a vertical arrangement as illustrated in FIG. 1. The subassembly 90 may be configured to work on any or all of the cartridges 40. In one embodiment, the subassembly 90 is configured to retract the biasing members 85 and/or the electrical connectors 87 associated with the three color cartridges 40 (i.e., magenta, cyan, and yellow) in a four-color printer, but not the black cartridge 40.

The bias control arm 91 includes a first set of positioning members 93 disposed toward the cartridge 40, and a second set of positioning members 94 disposed at about 90 degrees from the first set of positioning members 93. The first set of positioning members 93 are operative to change the position of the electrical connectors 87, and the second set of positioning members 94 are operative to change the position of the biasing members 85 as discussed in greater detail below. The positioning members 93, 94 include angled positioning surfaces 95A, 95B, 96A, 96B that contact and at least partially retract either the biasing members 85 and/or the electrical connectors 87. As the biasing members 85 and/or the electrical connectors 87 are retracted, the biasing force on the cartridge is reduced until finally the cartridge 40 moves away from the photoconductor unit 50, and the developer member 45 is spaced apart from the photoconductive member 51.

As stated previously, it may be advantageous to stop the developer member 45 and the agitating member 42 in the color cartridges 40 when printing black-only images. In one embodiment, this may be achieved by retracting the color cartridge 40 from the photoconductor unit 50. However, in addition to this mechanical movement, consideration may be given to whether any or all electrical connections to the cartridge 40 are to be maintained when the cartridge 40 is retracted, and whether the drive motor 18 should be stopped. Also, if the cartridge 40 is retracted for black-only printing, it should be engaged again for color printing. In order for a transition between a color printing mode and a black-only printing mode to take place, an amount of time may be required to complete the mechanical movements and adjust electrical connections. During this time, it may not be possible to continue printing media sheets. Therefore, it may be advantageous to minimize the time required for each transition. The methods described below provide a sequence of events that may reduce transition time and increase throughput.

Figure 12:
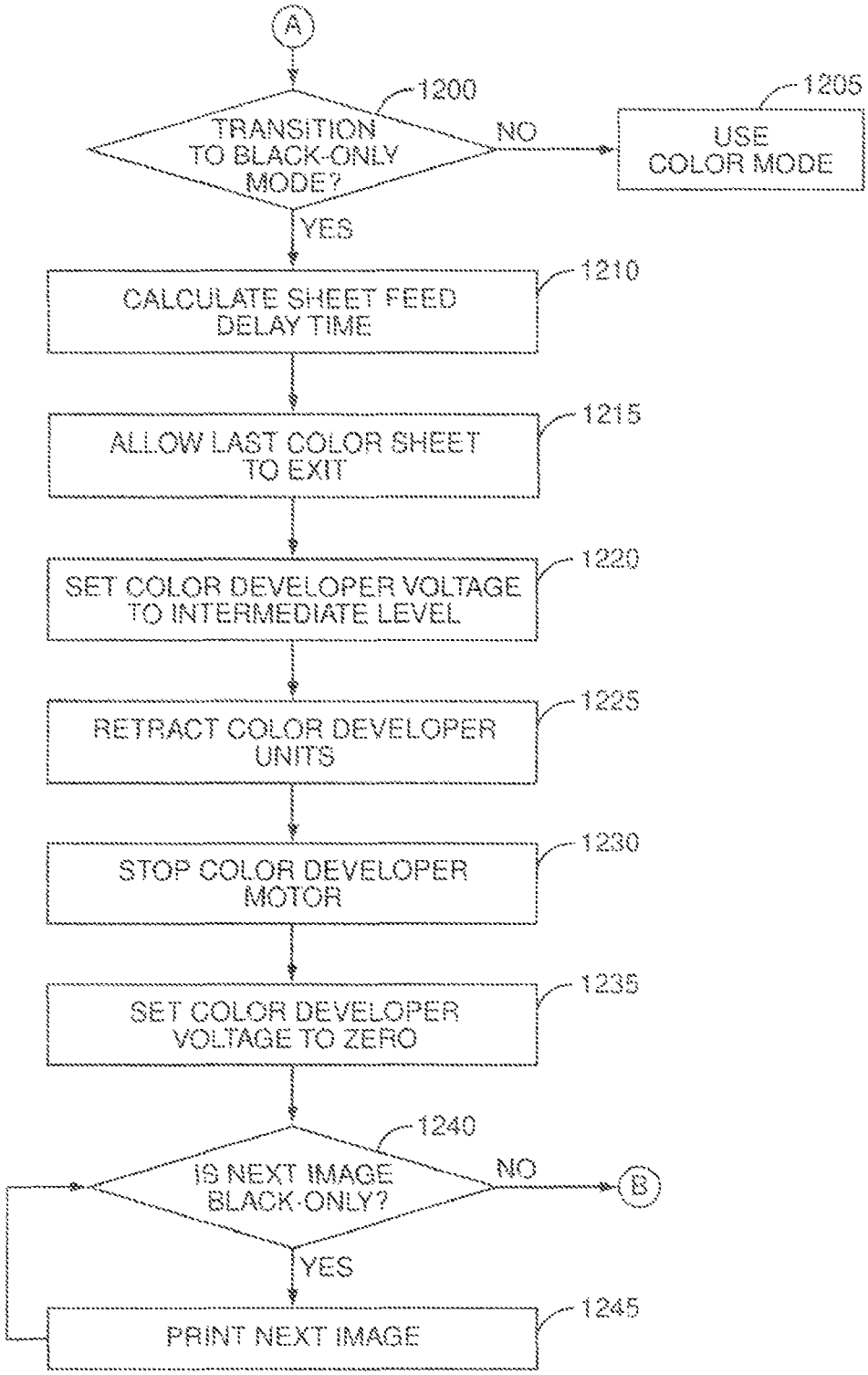
FIG. 12 is a process diagram of a method for transitioning from color printing to black-only printing according to one embodiment.

FIG. 12 illustrates a process diagram for one embodiment of a method to transition from color printing to black-only printing. First, the controller 15 makes a determination that that the transition from color printing to black-only printing should be made (step 1200). If there is no transition, the controller 15 continues to operate the image forming device 10 in color mode (step 1205). The decision to make the transition, whether from color to black-only printing or from black-only printing to color printing, is based on a variety of factors. These factors may include, for example, the number of sequential color or black-only images in the print queue, whether a color or black-only image is in the print queue, whether the current print job is simplex or duplex, and whether the image forming device is idle. One embodiment of a decision-making algorithm for transitioning between color and black-only printing is described in U.S. patent application Ser. No. 12/049,407 entitled "Control Algorithms for Transitioning Between Color Printing and Black-Only Printing in an Image Forming Device" filed on Mar. 17, 2008 and assigned to Lexmark International, Inc., the owner of the present application, and herein incorporated by reference in its entirety.

Once the controller 15 has determined that the transition should be made, the controller 15 then determines a delay time between the last media sheet to receive a color image and the next media sheet to be fed which will receive the first black-only image (step 1210). The delay time may take into account the time needed to make the transition as discussed below, as well as the time to pick and feed the media sheet from the media tray 14. For example, the image forming device 10 may include a plurality of media trays 14 stacked upon one another. The distance from the bottom-most media tray 14 in the stack to the image forming units 100 may be greater than the distance from the top-most media tray 14. Thus, the media sheet fed from the bottom-most tray will require more time to reach the image forming units 100 than the media sheet fed from the top-most media tray 14. Therefore, the point at which the media sheet is picked from the media tray 14 may occur at any time during the transition, and is calculated so that the movement of the media sheet coincides with the transition given the path that the media sheet may take to reach the image forming units 100.

The delay time may be measured as an interpage gap and may include a fixed portion and a variable portion. The fixed portion may be determined by the physical spacing of the color image forming units 100, as well as the distance between the nip at the developer member 45 of the last color image forming unit 100 and a transfer nip of the last color image forming unit 100. In one embodiment, the distance between the first and third color image forming units 100 is 100 mm, and the distance between the developer and transfer nips of the last color imaging unit 100 is 20 mm. Accounting for the 20 mm spacing is necessary to allow the media sheet to pass through the last color transfer nip since this media sheet has a color image. Thus, the total fixed distance from the developer nip of the first color image forming unit 100 to the transfer nip of the last color image forming unit 100 is 120 mm. In one embodiment, the controller 15 uses 125 mm as the physical spacing to allow a small margin of error.

The variable portion of the delay time is related to a process speed of the image forming device, which is the speed at which media sheets are moved through the image forming units 100. During the time needed to complete the movement of the bias control arm 91, the last media sheet to receive a color image continues to move through the image forming device. In one embodiment, the image forming device runs at a rate of 35 sheets/minute, which translates to a process speed of about 0.193 mm/ms. The bias control arm 91 requires about 600 ms to move between the first and second positions, and during this time the last color media sheet travels about 115 mm (600 ms×0.193 mm/ms).

Thus, the interpage gap may be 240 mm (125 mm+115 mm). At a process speed of 0.193 mm/ms, the delay time prior to feeding the first media sheet to receive the black-only image is about 1300 ms.

The controller 15 now tracks the trailing edge of a last sheet to receive a color image until the trailing edge reaches the transfer nip of the last color cartridge 40 (step 1215). As the trailing edge passes the last color cartridge 40, the voltage on all three of the color developer members 45 (i.e., magenta, cyan, and yellow) is set to an intermediate level with a magnitude less than the magnitude of the voltage used for printing images (step 1220). In one embodiment, the intermediate level is about −72 volts and the voltage used for printing images is about −600 volts. Other embodiments may include higher or lower levels depending on the particular architecture of the image forming device 10 and specific bias values used for the developer member 45, photoconductive member 51, and other charged components within the image forming device 10.

The intermediate voltage prevents a high bias level between the developer member 45 and the doctor blade 47. In one embodiment, an electrical connection to the doctor blade 47, as well as power to the doctor blade 47, is maintained throughout the transition, while an electrical connection to the developer member 45 may be disconnected during the transition. This avoids the possibility of generating an opposite bias at a nip between the doctor blade 47 and developer member 45, as the voltage on the doctor blade 47 is typically higher in magnitude than the voltage on the developer member 45. When the developer member 45 electrical connection is disconnected, the charge on the developer member 45 may vary between ground and the charge on the toner adder roller 44. If the charge on the developer member 45 goes to ground (zero volts), setting the developer member 45 voltage to the intermediate level avoids a large bias between the developer member 45 and the doctor blade 47, while avoiding the possibility of generating an opposite bias between the two. Otherwise, damage to the toner could result which could lead to print quality defects.

The controller 15 then starts the motor 35 operatively attached to the bias control arm 91, which moves the bias control arm 91. When the bias control arm 91 completes its movement, the color cartridges 40 have retracted from their respective photoconductor units 50 (step 1225). This retraction generates a gap between each of the color developer members 45 and the color photoconductive members 51. The controller 15 may run the motor for a period of time to assure complete travel of the bias control arm 91.

Once the bias control arm 91 movement is completed, the controller 15 stops the drive motor 18 driving the developer members 45 and agitating members 42 of the color cartridges 40 (step 1230). Thus, the developer members 45 are rotating at normal operating speed when retracted from the photoconductive members 51. This sequence minimizes an amount of toner developed onto the photoconductive members 51 during the transition. In one embodiment, the drive motor 18 includes a brake system to reduce the amount of time to stop the drive motor 18, which reduces an overall amount of time to complete the transition and may increase the throughput of the image forming device. Once the drive motor 18 is stopped, the voltage on the developer members 45 is set to zero (step 1235).

At this point, the three color cartridges 40 are in the retracted position, leaving only the black cartridge 40 engaged with the black photoconductor unit 50. The image forming device is now ready for black-only printing. The controller 15 then determines whether each subsequent image is black-only (step 1240) and if so, prints the subsequent image (step 1245). If a subsequent image is not black-only, the controller 15 may transition to color printing as described below.

Figure 13:
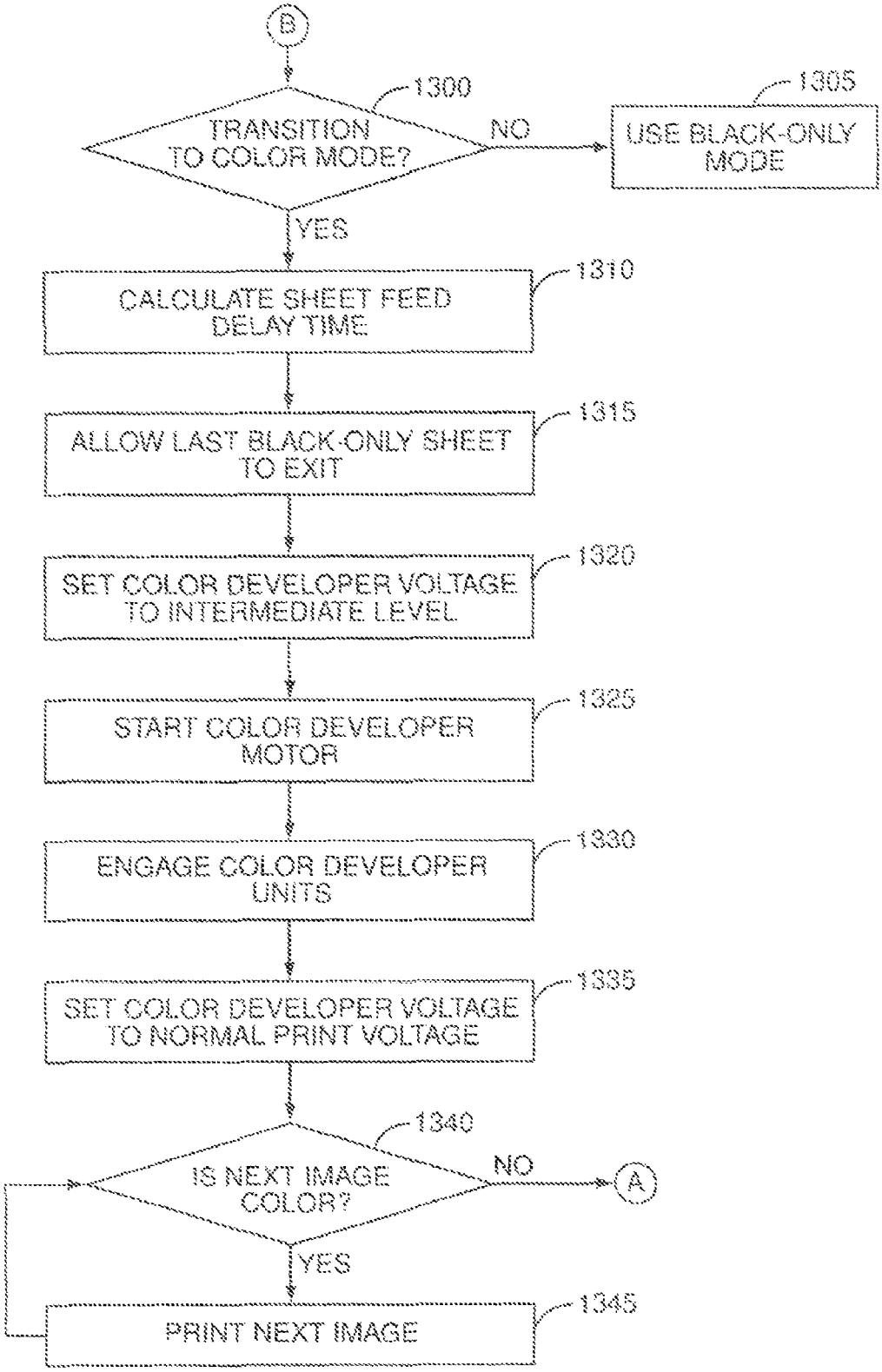
FIG. 13 is a process diagram of a method for transitioning from black-only printing to color printing according to one embodiment.

FIG. 13 illustrates a process diagram for one embodiment of a method to transition from black-only printing to color printing. First, the controller 15 makes a determination that a transition from black-only printing to color printing should be made (step 1300). If not, the controller 15 continues to operate the image forming device 10 in black-only mode (step 1305). At this point, the image forming device 10 is in the black-only printing mode, which means that the three color cartridges 40 are in the retracted position such that the color developer members 45 are spaced apart from the color photoconductive members 51, and the drive motor for the color developer members 45 is shut off.

The controller 15 now determines a delay time between the last sheet to receive a black-only image and the first sheet to receive a color image (step 1310) similar to the delay time describe above for the transition from color printing to black-only printing. The delay time may be measured as an interpage gap and may include a fixed portion and a variable portion. The fixed portion may be determined only by the physical spacing of the color image forming units 100, which is 100 mm. The color to black-only transition does not need to account for the distance between the developer and transfer nips of the last color image forming unit 100 because there is no color image to be transferred at the last color image forming unit 100. Thus, as stated above, the controller 15 tracks the trailing edge of the last media sheet with a black-only image until the trailing edge is even with the developer nip of the last color image forming unit 100 (in the color to black-only transition, the controller 15 tracks the trailing edge until it reaches the transfer nip of the last color image forming unit 100, which is 20 mm further downstream from the developer nip).

The variable portion of the delay time is related to a process speed of the image forming device, which is the speed at which media sheets are moved through the image forming units 100. During the time needed for the bias control arm 91 to complete its movement and the time needed to accelerate the drive motor 18, the last media sheet to receive a black-only image continues to move through the image forming device. In one embodiment, the image forming device runs at a rate of 35 sheets/minute, which translates to a process speed of about 0.193 mm/ms. The bias control arm 91 requires about 600 ms to complete its movement, and the drive motor 18 requires about 800 ms to reach operating speed for a total of 1400 ms. During this time, the last black-only media sheet travels about 270 mm (1400 ms×0.193 mm/ms).

Thus, the interpage gap may be 370 mm (100 mm+270 mm). In one embodiment, an additional 80 mm is added to the interpage gap to allow the image forming units 100 an additional amount of time to correct for any print quality defects arising as a result of the transition. The total interpage gap is then 450 mm. At a process speed of 0.193 mm/ms, the delay time prior to feeding the first media sheet to receive the color image is about 2400 ms.

The controller 15 now tracks the trailing edge of a last sheet to receive a black-only image until the trailing edge is even with the developer member 45 location of the last color cartridge 40 (step 1315). As the trailing edge passes the last color cartridge 40, the voltages on all three of the color developer members 45 is set to an intermediate level with a magnitude less than the magnitude of the voltage used for printing images (step 1320). As described above for the color to black-only transition, the intermediate level may be −72 volts in one embodiment, or another value in other embodiments. An intermediate level is necessary when engaging the developer members 45 and photoconductive members 51 for at least the reasons stated above for disengaging the members 45, 51.

The controller 15 now starts the drive motor 18 for the three color cartridges (step 1325) and accelerates the color developer members 45 up to normal printing speed. In one embodiment, the developer members 45 are not synchronized with the photoconductive members 51 during acceleration, which reduces the time needed to bring the developer members 45 up to normal printing speed.

Once the developer members 45 reach normal operating speed, the controller 15 starts the motor 35 to move the bias control arm 91 to the position where the color cartridges 40 are engaged with the photoconductor units 50 (step 1330). Just prior to completing this movement, the controller 15 increases the magnitude of the voltage of the color developer members 45 to the normal voltage used for printing images (step 1335). In one embodiment, the movement of the bias control arm 91 takes about 600 ms, and the magnitude of the voltage is increased on the developer members 45 after about 500 ms. This sequence reduces the bias differential between the developer members 45 and the photoconductive members 51 as the two make contact with one another.

The controller 15 then determines whether each subsequent image is color (step 1340) and if so, prints the subsequent image (step 1345). If a subsequent image is not color, the controller 15 may transition to black-only printing as described above.

Referring back to FIG. 7, the gear side of the cartridge 40 is illustrated. At least one of the gears mesh with a drive gear of the main unit 12 (not shown). As described above, the cartridge may have a range of motion between an engaged position where the developer member 45 and the photoconductive member 51 are in contact with one another and a retracted position where the developer member 45 and the photoconductive member 51 are spaced apart. In one embodiment, the gears of the cartridge remain meshed with the drive gear of the main unit 12. Thus, the developer member 45 and the agitating members 42 may be rotated or stopped from rotating at any desired point along the range of movement of the cartridge 40.

The embodiments described above relate to a two-piece cartridge in which the developer unit 40 is contained in one piece, and the photoconductor unit 50 is contained in the other piece. In another embodiment, the cartridge is a single piece and contains both the developer unit 40 and the photoconductor unit 50 in that one piece. In this latter embodiment, the bias control arm 91 may, for example, bias the cartridge toward the transfer belt 20 to form a nip between the photoconductive member 51 and a transfer roller. The methods described above may be used to move the single piece cartridge away from the transfer belt 20, at which point the cartridge may be shut off, reducing toner churn as described above.

The term "image forming device" and the like is used generally herein as a device that produces images on a media sheet. Examples include but are not limited to a laser printer, ink-jet printer, fax machine, copier, and a multi-functional machine. One example of an image forming device is Model No. C530 from Lexmark International of Lexington, Ky.

The term "imaging device" refers to a device that arranges an electrical charge on the photoconductive element 51. Various imaging devices may be used such as a laser printhead and a LED printhead.

The transport belt 20 is illustrated in the embodiments for moving the media sheets past the image forming units 100, and as part of the subunit 13. In another embodiment, roller pairs are mounted to the subunit 13 and spaced along the media path. The roller pairs move the media sheets past the image forming units 100. In one embodiment, each of the roller pairs is mounted on the subunit 13. In another embodiment, one of the rollers is mounted on the subunit 13, and the corresponding roller of the pair is mounted on the main body 12. In yet another embodiment, rollers may be positioned within the photoconductor unit 50.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method for transitioning from color printing to black-only printing in an image forming device, comprising:

contacting a black developer unit with a black photoconductor unit;

while maintaining contact between the black developer unit and the black photoconductor unit, adjusting a magnitude of a voltage supplied to a color developer unit to a first reduced level;

after reducing the magnitude of the voltage, moving the color developer unit from a first position in contact with a color photoconductor unit to a second position spaced from the color photoconductor unit;

reducing a speed of a drive motor driving the color developer unit after the color developer unit is in the second position; and after reducing the speed of the drive motor, adjusting the magnitude of the voltage to a second reduced level less than the first reduced level.

2. The method of claim 1, wherein adjusting the magnitude of the voltage supplied to the color developer unit to the first reduced level comprises reducing the magnitude of the voltage supplied to a color developer member to a non-zero value less than a magnitude of a voltage used to print color images.

3. The method of claim 2, wherein adjusting the magnitude of the voltage supplied to the color developer member to the first reduced level comprises reducing the magnitude of the voltage supplied to the color developer member to less than half of the voltage used to print color images.

4. The method of claim 1, wherein reducing the speed of the drive motor comprises stopping the drive motor.

5. The method of claim 1, wherein moving the color developer unit from the first position to the second position comprises moving a color developer member in the color developer unit to a position spaced from a photoconductive member in the color photoconductor unit.

6. The method of claim 1, wherein adjusting the magnitude of the voltage supplied to a color developer unit to the first reduced level comprises adjusting the magnitude of at least one voltage supplied to the color developer unit to the first reduced level.

7. The method of claim 1, further comprising maintaining a voltage bias between the black developer unit and the black photoconductor unit while moving the color developer unit from the first position to the second position.

8. The method of claim 1, wherein adjusting the magnitude of the voltage to the second reduced level comprises adjusting the magnitude of the voltage to zero.

9. The method of claim 1, further comprising disconnecting from the color developer unit an electrical connection supplying voltage to the color developer unit while moving the color developer unit to the second position.

10. The method of claim 4, further comprising stopping agitating members within a toner reservoir in the developer unit when stopping the drive motor.

11. A method for transitioning from color printing to black-only printing in an image forming device, comprising:

contacting a black developer member with a black photoconductive member;

while maintaining the black developer member in contact with the black photoconductive member, setting a magnitude of a voltage supplied to a plurality of color developer members to a non-zero value less than a magnitude of a voltage used to form a color image;

after setting the magnitude of the voltage supplied to the plurality of color developer members, moving each of the plurality of color developer members apart from color photoconductive members;

once the plurality of color developer members are spaced apart from the color photoconductive members, stopping a drive motor driving the plurality of color developer members;

setting the magnitude of the voltage supplied to the plurality of color developer members to zero after stopping the drive motor.

12. The method of claim 11, further comprising maintaining a voltage bias between the black developer member and the black photoconductive member while moving the plurality of color developer members apart from the color photoconductive members.

13. The method of claim 11, further comprising disconnecting from each of the plurality of color developer members an electrical connection supplying voltage to each of the plurality of color developer members while moving the plurality of color developer members apart from the color photoconductive members.

14. The method of claim 11, further comprising stopping agitating members within toner reservoirs operatively connected to each of the plurality of color developer members when stopping the drive motor.

15. A method for transitioning between color printing and black-only printing in an image forming device, comprising:

determining that at least one image in a print queue is a black-only image;

after determining that the at least one image in the print queue is a black-only image, reducing a magnitude of a voltage on a color developer member to a first non-zero intermediate level;

retracting the color developer member with the reduced magnitude voltage apart from a color photoconductive member;

after retracting the color developer member, stopping a color developer member drive motor;

further reducing the magnitude of the voltage on the color developer member after stopping the color developer member drive motor;

after further reducing the magnitude of the voltage on the color developer member, printing the black-only image on the first media sheet;

after printing the black-only image, determining that a subsequent image in the print queue is a color image;

increasing the magnitude of the voltage on the color developer member to a second intermediate level after determining that the subsequent image in the print queue is a color image;

starting the color developer member drive motor after increasing the magnitude of the voltage on the color developer member to the second intermediate level;

after starting the color developer member drive motor, engaging the color developer member with the color photoconductive member; and once the color developer member engages with the color photoconductive member, increasing the magnitude of the voltage on the color developer member to a level above the second intermediate level.

16. The method of claim 15, wherein increasing the magnitude of the voltage on the color developer member to a second intermediate level comprises increasing the magnitude of the voltage on the color developer member to the first intermediate level.

17. The method of claim 15, wherein the magnitude of each of the first and second intermediate voltage levels is less than half of the magnitude of a voltage used to form color images.

18. The method of claim 15, wherein further reducing the magnitude of the voltage on the color developer member comprises reducing the magnitude of the voltage on the color developer member to zero.

19. The method of claim 15, wherein increasing the magnitude of the voltage on the color developer member to a level greater than the second intermediate level occurs prior to completing the step of engaging the color developer member with the color photoconductive member.

20. The method of claim 15, further comprising stopping agitating members within toner reservoirs operatively connected to the color developer member when stopping the drive motor.

* * * * *